US005893274A

United States Patent [19]

Nagelvoort et al.

[11] Patent Number: 5,893,274

[45] Date of Patent: Apr. 13, 1999

[54] METHOD OF LIQUEFYING AND TREATING A NATURAL GAS

[75] Inventors: Robert Klein Nagelvoort; Kornelis Jan Vink, both of The Hague, Netherlands

[73] Assignee: Shell Research Limited, United Kingdom

[21] Appl. No.: 08/981,015

[22] PCT Filed: Jun. 21, 1996

[86] PCT No.: PCT/EP96/02760

§ 371 Date: Dec. 23, 1997

§ 102(e) Date: Dec. 23, 1997

[87] PCT Pub. No.: WO97/01069

PCT Pub. Date: Jan. 9, 1997

[30] Foreign Application Priority Data

Jun. 23, 1995 [EP] European Pat. Off. ..... 95201709

[51] Int. Cl.[6] ..... F25J 1/00

[52] U.S. Cl. ..... 62/613; 62/619

[58] Field of Search ..... 62/613, 619

[56] References Cited

U.S. PATENT DOCUMENTS 3,735,600 5/1973 Dowdell et al. ..... 62/619

4,970,867 11/1990 Herron et al. ..... 62/613

FOREIGN PATENT DOCUMENTS 0254278 1/1988 European Pat. Off. .

1572899 8/1980 United Kingdom .

*Primary Examiner*—Ronald Capossela

[57] ABSTRACT

A method is provided to liquefy and treat natural gas containing components having low boiling points, the method includes: liquefying natural gas in a main heat exchanger; cooling the liquefied gas in an external heat exchanger; allowing the cooled liquefied gas to expand dynamically; introducing the expanded fluid in the upper part of a fractionation column; allowing the liquid of the expanded fluid to flow downwards thorough contacting section; withdrawing a liquid recycle stream which is passed through the heat exchanger to obtain a heated two-phase fluid; introducing the two-phase fluid in fractionation column, and allowing the vapour to flow through the contacting section; collecting the liquid of the two-phase fluid in the lower part of the fractionation column; and withdrawing therefrom a liquid product stream having a reduced content of components having low boiling points; and withdrawing from the fractionation column a gaseous stream which is enriched in components having low boiling points.

6 Claims, 3 Drawing Sheets

METHOD OF LIQUEFYING AND TREATING A NATURAL GAS

The present invention relates to a method of liquefying and treating natural gas containing components having low boiling points. The components having low boiling points are generally nitrogen, helium and hydrogen, these components are also called "light components". In this method the liquefied gas is liquefied at liquefaction pressure, and subsequently the pressure of the liquefied gas is reduced to obtain liquefied gas having a reduced content of components having a low boiling point at a low pressure, which liquefied gas can be further treated or stored. The treating part of the method is sometimes called an end flash method. Such an end flash method serves two ends, first reducing the pressure of the liquefied gas to the low pressure, and second separating a gaseous stream including components having low boiling points from the liquefied gas, thus ensuring that the remaining liquefied gas has a sufficiently low content of components having low boiling points.

The liquefaction pressure of natural gas is generally in the range of from 3.0 to 6.0 MPa. The low pressure is below the liquefaction pressure, for example the low pressure is less than 0.3 MPa and suitably the low pressure is about atmospheric pressure, between 0.10 and 0.15 MPa.

Known is a method of liquefying and treating a natural gas containing components having low boiling points which method comprises the steps of:

(a) passing the natural gas at liquefaction pressure through the product side of a main heat exchanger;

(b) introducing cooled liquefied refrigerant at refrigerant pressure in the cold side of the main heat exchanger, allowing the cooled refrigerant to evaporate at the refrigerant pressure in the cold side of the main heat exchanger to obtain vaporous refrigerant at refrigerant pressure, and removing vaporous refrigerant from the cold side of the main heat exchanger;

(c) removing the liquefied gas at liquefaction pressure from the product side of the main heat exchanger;

(d) allowing the cooled liquefied gas to expand over an expansion valve to a low pressure to obtain expanded fluid;

(e) supplying the expanded fluid to a separator vessel;

(f) withdrawing from the bottom of the separator vessel a liquid product stream having a reduced content of components having low boiling points; and (g) withdrawing from the top of the separator vessel gaseous stream which is enriched in components having low boiling points.

A different method of liquefying and treating a natural gas containing components having low boiling points is described in UK patent specification No. 1 572 899. This method comprises the steps of:

(a) passing the natural gas at liquefaction pressure through the product side of a main heat exchanger;

(b) introducing cooled liquefied refrigerant at refrigerant pressure in the cold side of the main heat exchanger, allowing the cooled refrigerant to evaporate at the refrigerant pressure in the cold side of the main heat exchanger to obtain vaporous refrigerant at refrigerant pressure, and removing vaporous refrigerant from the cold side of the main heat exchanger;

(c) removing the liquefied gas at liquefaction pressure from the product side of the main heat exchanger;

(d) passing the liquefied gas through the hot side of a heat exchanger arranged in the lower part of a fractionation column to obtain cooled liquefied gas;

(e) allowing the cooled liquefied gas to expand over an expansion valve to a low pressure to obtain expanded fluid;

(f) spraying the expanded fluid in the top of the fractionation column;

(g) withdrawing from the bottom of the fractionation column a liquid product stream having a reduced content of components having low boiling points; and (h) withdrawing from the upper part of the fractionation column a gaseous stream which is enriched in components having low boiling points.

In the latter method the heat exchanger in which the liquefied gas is cooled is formed by the lower part of the fractionation column, and the hot side of the heat exchanger comprises a tube bundle arranged in the lower part of the fractionation column. The liquid in the lower part of the fractionation column cools the liquefied gas passing through the tube bundle. It will therefore be understood that withdrawing the liquid stream from the bottom of the fractionation column in step (g) has to be conducted at such a rate that the tube bundle of the heat exchanger remains submerged in liquid.

Such a heat exchanger is a so-called internal reboiler. An internal reboiler, however, cannot be designed separately from the fractionation column, and consequently the allowable heat transfer area per unit of column height is affected by the required dimensions of the fractionation column. Since the heat transfer area has an effect on the process design, mechanical limitations affect the process design and this may lead to a process design that is not optimal.

It is an object of the present invention to overcome the above-mentioned drawbacks. It is a further object of the present invention to obtain a larger temperature drop in the expanding liquefied gas and, consequently, to obtain a better overall liquefaction efficiency, wherein the liquefaction efficiency is the ratio of the flow rate of natural gas being liquefied over the power required to compress the refrigerant.

To this end the method of liquefying and treating natural gas containing components having low boiling points according to the present invention comprises the steps of:

(a) passing the natural gas at liquefaction pressure through the product side of a main heat exchanger;

(b) introducing cooled liquefied refrigerant at refrigerant pressure in the cold side of the main heat exchanger, allowing the cooled refrigerant to evaporate at the refrigerant pressure in the cold side of the main heat exchanger to obtain vaporous refrigerant at refrigerant pressure, and removing vaporous refrigerant from the cold side of the main heat exchanger;

(c) removing the liquefied gas at liquefaction pressure from the product side of the main heat exchanger;

(d) passing the liquefied gas through the hot side of an external heat exchanger to obtain cooled liquefied gas;

(e) allowing the cooled liquefied gas to expand to a low pressure to obtain expanded fluid, at least part of the expansion being done dynamically;

(f) introducing the expanded fluid in the upper part of a fractionation column provided with a contacting section arranged between the upper part and the lower part of the fractionation column;

(g) allowing the liquid of the expanded fluid to flow downwards through the contacting section;

(h) withdrawing from the fractionation column a liquid recycle stream which includes liquid flowing out of the contacting section;

(i) passing the liquid recycle stream through the cold side of the external heat exchanger to obtain a heated two-phase fluid;

(j) introducing at least the vapour of the two-phase fluid in the fractionation column between the lower part and the contacting section, and allowing the vapour to flow upwards through the contacting section;

(k) collecting at least part of the liquid of the two-phase fluid in a product receptacle, and withdrawing from the product receptacle a liquid product stream having a reduced content of components having low boiling points; and (l) withdrawing from the upper part of the fractionation column a gaseous stream which is enriched in components having low boiling points.

Reference is made to U.S. Pat. No. 3 203 191. This publication discloses that part of the expansion of the liquefied gas from the main heat exchanger is done dynamically in an expansion engine. According to this publication the result is that for a given pressure reduction the amount of liquefied gas that evaporates is less than the amount that evaporates if the expansion is done in an expansion valve.

The invention will now be described in more detail by way of example with reference to the accompanying drawings, wherein FIG. 1 shows schematically and not to scale a line-up of the process according to the present invention;

Figure 1:
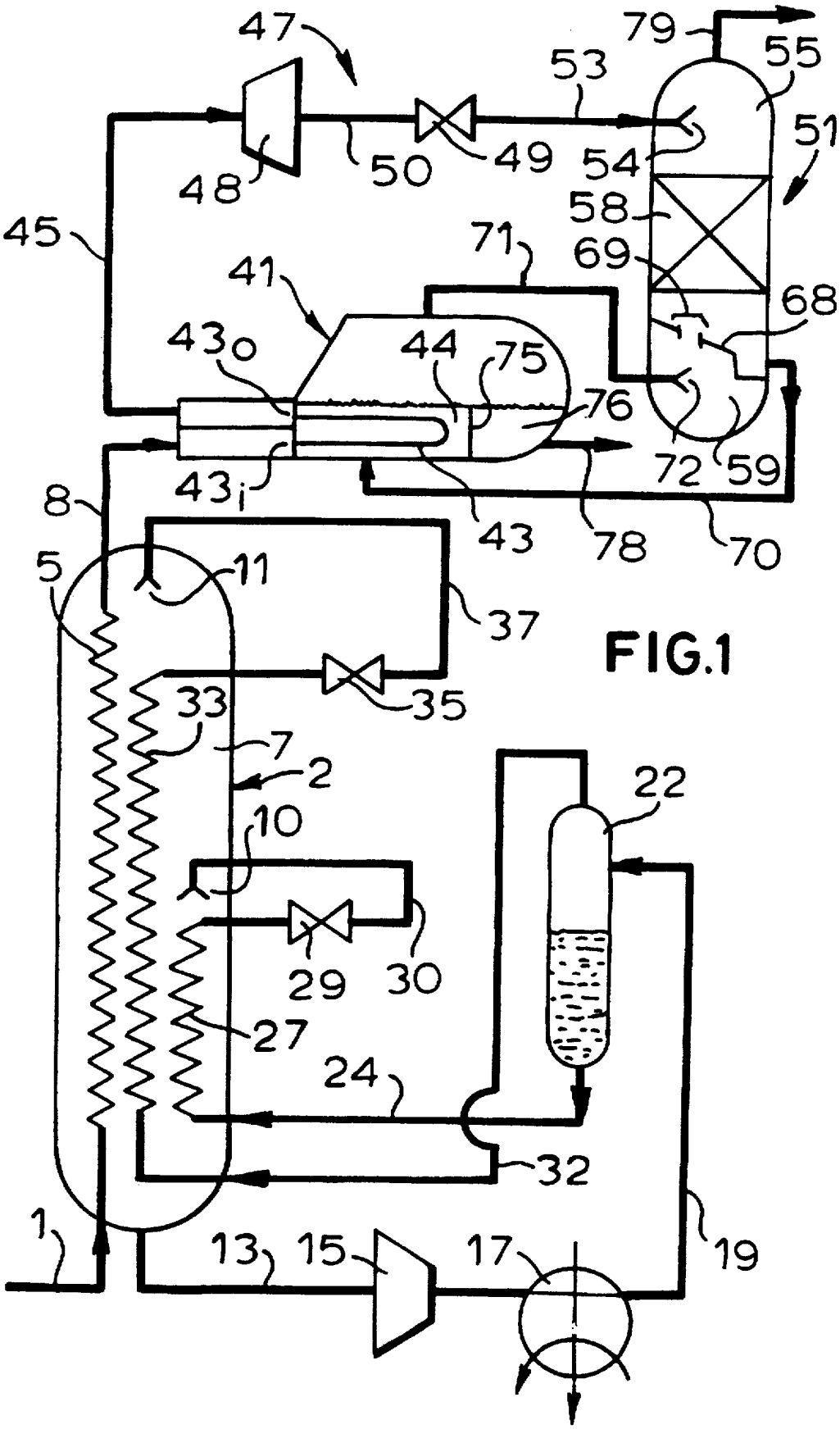

Reference is now made to FIG. 1. A natural gas containing components having low boiling points is supplied through conduit 1 to a main heat exchanger 2. The natural gas contains about 4 mol % of nitrogen and 200 ppmv (parts per million by volume) of helium. The natural gas is at its liquefaction pressure of 4 MPa.

The main heat exchanger 2 comprises a product side 5 which is in heat exchange relation with a cold side 7. In the main heat exchanger 2 shown in FIG. 1, the product side 5 is the tube side and the cold side 7 is the shell side.

The natural gas is passed at the liquefaction pressure through the product side 5 of the main heat exchanger 2, and it leaves the product side 5 through conduit 8. The temperature of the natural gas from the main heat exchanger 2 is −150° C.

In order to cool and liquefy the natural gas passing through the product side 5 of the main heat exchanger 2, cooled liquefied refrigerant is introduced in the cold side 7 of the main heat exchanger 2. In the line-up shown in FIG. 1, cooled liquefied refrigerant is introduced at two levels through inlet devices 10 and 11. The refrigerant is allowed to evaporate at refrigerant pressure in the cold side 7, and vaporous refrigerant is removed from the main heat exchanger 2 through conduit 13. The cooled liquefied refrigerant is obtained in the following way. The vaporous refrigerant removed through conduit 13 is compressed in compressor 15 to elevated pressure and the compressed fluid is partially condensed in heat exchanger 17 to obtain a partly condensed two-phase refrigerant fluid which is supplied through conduit 19 to a separator vessel 22. In the separator vessel 22 the refrigerant fluid is separated in a first condensed fraction and a first vaporous fraction. The first condensed fraction is passed through conduit 24 to the main heat exchanger 2. In the main heat exchanger 2 the first condensed fraction is cooled and liquefied in a first refrigerant side 27 to obtain a cooled first condensed fraction at elevated pressure. The cooled first condensed fraction is allowed to expand over expansion valve 29 in conduit 30 to obtain expanded fluid at refrigerant pressure. The expanded fluid at refrigerant pressure is introduced in the cold side 7 of the main heat exchanger 2 through the inlet device 10 arranged at the end of conduit 30. The first vaporous fraction is supplied through conduit 32 to the main heat exchanger 2. In the main heat exchanger 2 the first vaporous fraction is cooled and liquefied in a second refrigerant side 33 to obtain a cooled second condensed fraction at elevated pressure. The cooled second condensed fraction is allowed to expand over expansion valve 35 arranged in conduit 37 to obtain expanded fluid at refrigerant pressure. The expanded fluid at refrigerant pressure is introduced in the cold side 7 of the main heat exchanger 2 through inlet device 11 arranged at the end of conduit 37. The first and second refrigerant sides, 27 and 33 are in heat exchange relation with the cold side 7.

The multi-component liquefied gas is withdrawn from the main heat exchanger 2 through conduit 8 and supplied to a treating part which will be described below.

The liquefied natural gas is supplied through conduit 8 to an external heat exchanger 41. The liquefied gas passes through the hot side 43 in the form of the tube side of the heat exchanger 41. In the heat exchanger 41 the liquefied gas is cooled by means of indirect heat exchange with a cooling agent that flows through the cold side 44 in the form of the shell side of the heat exchanger 41 to obtain cooled liquefied gas which is removed through conduit 45. The cooling agent will be discussed in a later stage.

The heat exchanger 41 is of the kettle-type, which is known as such and which will not be discussed in detail.

The cooled liquefied gas is allowed to expand in an expansion device 47. The expansion device 47 comprises an expansion engine 48 in which the expansion is done dynamically and an expansion valve 49 connected to the expansion engine 48 by means of a conduit 50. The expansion is done in two stages to prevent evaporation in the expansion engine 48 and to allow more flexible operation. The pressure after expansion is the pressure at which the expanded fluid is treated in a fractionation column 51. As a result of the cooling and expansion, the temperature of the expanded fluid is lower than that of the liquefied natural gas passing through conduit 8 and part of the nitrogen and the helium evaporates.

The expanded fluid from the expansion device 47 is introduced through conduit 53 provided with an inlet device 54 into the upper part 55 of the fractionation column 51, which fractionation column 51 operates at substantial atmospheric pressure. The fractionation column 51 is provided with a contacting section 58 arranged between the upper part 55 and a lower part 59 of the fractionation column 51. The contacting section 58 as shown in FIG. 1 comprises sieve trays (not shown). The sieve trays are known per se and will not be discussed in more detail.

The liquid phase of the expanded fluid is allowed to flow downwards through the contacting section 58. Under the contacting section 58 there is arranged a draw-off tray 68 provided with a chimney 69. Liquid flowing out of the contacting section 58 is withdrawn from the fractionation column 51 via the draw-off tray 68. This liquid forms a recycle stream, and the recycle stream is passed to the external heat exchanger 41 through conduit 70.

The recycle stream is passed trough the cold side 44 of the external heat exchanger 41, and thus the recycle stream is the cooling agent that cools the liquefied natural gas. The recycle stream is heated so that a heated two-phase fluid is obtained. The vapour of the heated two-phase fluid is removed from the external heat exchanger 41 through conduit 71 and it is introduced into the lower part 59 of the fractionation column 51 through inlet device 72 arranged at the end of conduit 71 under the draw-off tray 68. The vapour passes through the chimney 69 and it flows upwards through the contacting section 58 to strip the liquid which flows downwards through the contacting section 58.

The liquid from the two-phase fluid flows over a weir 75 from the cold side 44 of the external heat exchanger 41 into a product receptacle 76. A product stream of liquefied natural gas having a reduced content of components having low boiling points is withdrawn from the product receptacle 76 through conduit 78. The product stream can be passed to storage (not shown) or to a further treatment (not shown).

From the upper part 55 of the fractionation column 51 is withdrawn through conduit 79 a gaseous stream which is enriched in components having low boiling points. This gaseous stream can be used as fuel gas. The gaseous stream can also be used as feed for a helium recovery unit (not shown).

The method of the present invention provides an efficient way of liquefying natural gas at liquefaction pressure and treating the natural gas to obtain liquefied natural gas at a lower pressure from which the components having low boiling points have been removed. The fractionation column and the heat exchanger can be optimized independently. Moreover the expansion over the expansion engine yields a larger temperature drop than that which could be obtained when expanding over an expansion valve only. And the feed to the expansion device is cooled which results in a better overall efficiency of the entire method.

An improvement of the above method can be obtained when the kettle-type heat exchanger is replaced by a counter-current heat exchanger. In a kettle-type heat exchanger the liquid in the cold side 44 is at substantially the same temperature so that the temperature of the liquid and the vapour leaving the cold side 44 is substantially equal to the temperature of the recycle stream entering into the cold side 44. Although the temperature of the liquid $43_o$ leaving the hot side 43 is below that of the liquid $43_i$ entering into the hot side 43, the exit temperature of the liquid $43_o$ cannot be below the temperature of the liquid flowing from the cold side 44 into the product receptacle 76. A counter-current heat exchanger, however, can be operated such that the temperature of the liquid leaving the hot side is below the temperature of the liquid leaving the cold side. Therefore the use of a counter-current heat exchanger further improves the overall efficiency.

In stead of expanding the refrigerant streams over expansion valves 29 and 35, the expansion of the refrigerant streams can be done dynamically over expansion engines (not shown).

Figure 2:
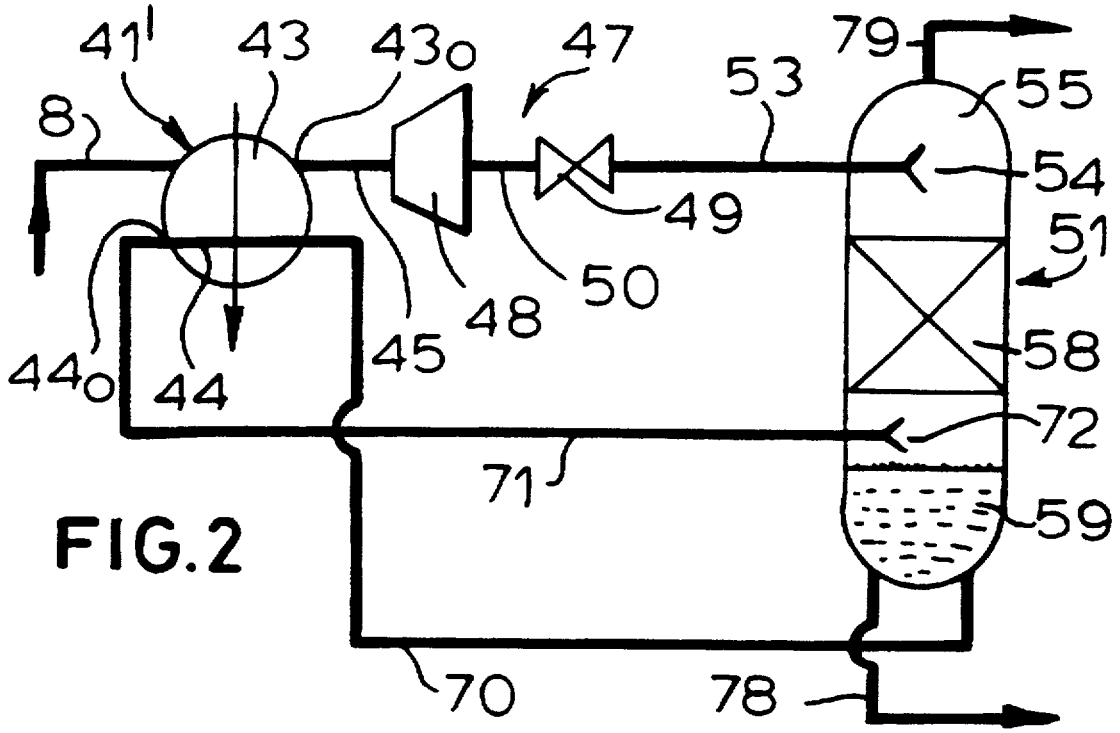
FIG. 2 shows schematically an alternative to the treating part of the line-up of FIG. 1.

Reference is now made to FIG. 2 showing an embodiment of the treating part of the present invention wherein a counter-current heat exchanger is employed. Equipment shown in FIG. 2 which is similar to equipment shown in FIG. 1 has got the same reference numeral, and for the sake of clarity the counter-current heat exchanger is referred to by reference numeral 41'.

As described above with reference to FIG. 1, a multi-component liquefied gas in the form of liquefied natural gas withdrawn from a main cryogenic heat exchanger (not shown) is passed through a conduit 8 to an external counter-current heat exchanger 41'. The liquefied gas passes through the hot side 43 in the form of the shell side of the heat exchanger 41'. In the heat exchanger 41' the liquefied gas is cooled by means of indirect heat exchange with a cooling agent that flows through the cold side 44 in the form of the tube side of the heat exchanger 41' to obtain cooled liquefied gas which is removed through conduit 45. The cooling agent will be discussed in a later stage.

The cooled liquefied gas is allowed to expand in expansion device 47 comprising expansion engine 48 in which the expansion is done dynamically and expansion valve 49 connected to the expansion engine 48 by means of conduit 50. The pressure after expansion is the pressure at which the expanded fluid is treated in the fractionation column 51. As a result of the cooling and expansion, the temperature of the expanded fluid is lower than that of the liquefied natural gas passing through conduit 8 and part of the nitrogen and the helium evaporates.

The expanded fluid from the expansion device 47 is introduced through conduit 53 provided with inlet device 54 into the upper part 55 of a fractionation column 51 operating at atmospheric pressure. The fractionation column 51 is provided with contacting section 58 arranged between the upper part 55 and the lower part 59 of the fractionation column 51. The contacting section 58 comprises sieve trays (not shown).

The liquid phase of the expanded fluid is allowed to flow downwards through the contacting section 58. The liquid is collected in the lower part 59 of the fractionation column 51, and a recycle stream is withdrawn from the fractionation column 51 through conduit 70. The recycle stream is passed to the external heat exchanger 41'.

The recycle stream is passed trough the cold side 44 of the external heat exchanger 41', and thus the recycle stream is the cooling agent that cools the liquefied natural gas. The recycle stream is heated so that a heated two-phase fluid is obtained. The heated two-phase fluid is removed from the heat exchanger 41' through conduit 71 and it is introduced into the lower part 59 of the fractionation column 51 through inlet device 72 arranged under the contacting section 58. The vapour is allowed to flow upwards through the contacting section 58, and the liquid is collected in the lower part 59 of the fractionation column 51. A product stream of liquefied natural gas having a reduced content of components having low boiling points is withdrawn from the lower part 59 of the fractionation column 51 through conduit 78. The product stream can be passed to storage (not shown) or to a further treatment (not shown). The lower part of the fractionation column serves as a receptacle for liquid from the heated two-phase fluid and for the liquid from the contacting section 58.

From the upper part 55 of the fractionation column 51 is withdrawn through conduit 79 a gaseous stream which is enriched in components having low boiling points. This gaseous stream can be used as fuel gas. The gaseous stream can also be used as feed for a helium recovery unit (not shown).

An advantage of this embodiment is that the counter-current heat exchanger 41' can be operated such that the temperature of the liquid $43_o$ leaving the hot side 43 is below the temperature of the liquid $44_o$ leaving the cold side 44. However, the recycle stream and the product stream have the same composition since they are removed from the lower part 59 of the fractionation column 51.

Figure 3:
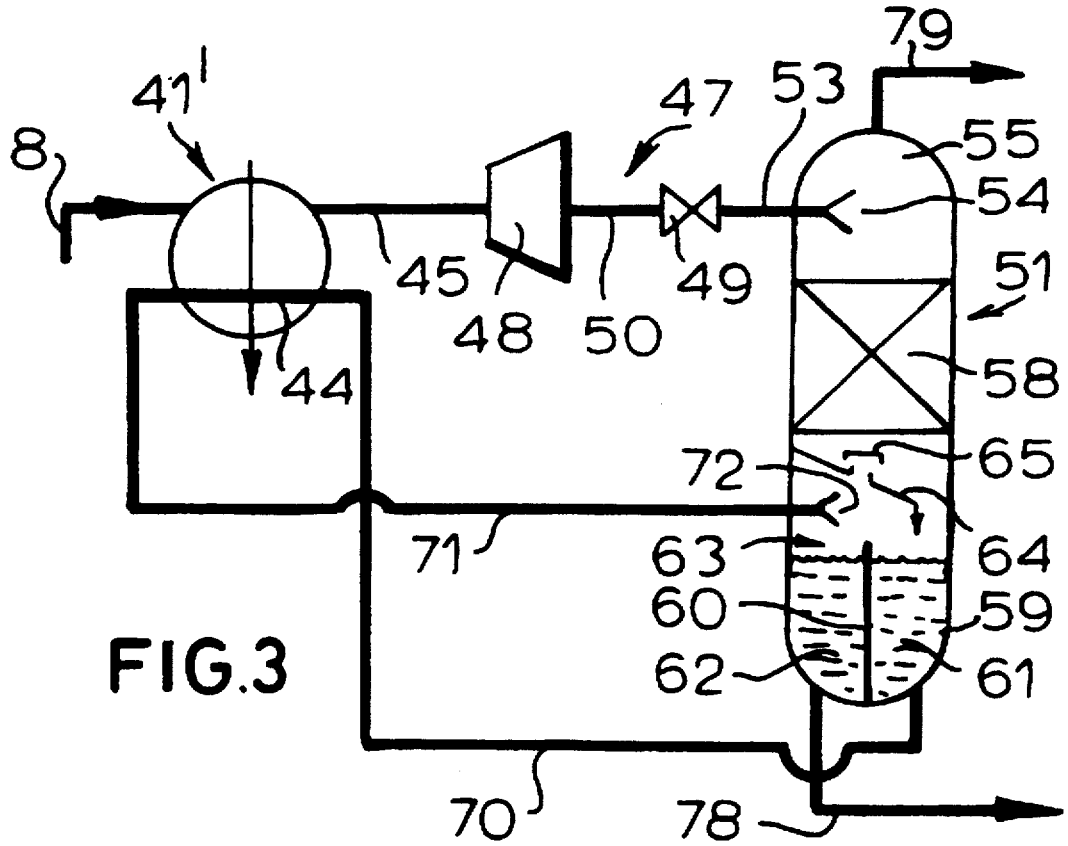
FIG. 3 shows schematically an alternative to the treating part of FIG. 2.

Separation of the streams can be achieved by arranging internals in the lower part 59 of the fractionation column 51. This improved embodiment is shown in FIG. 3. Equipment shown in FIG. 3 which is similar to equipment shown in FIG. 2 has got the same reference numeral, and for the sake of clarity only the differences between the methods of FIG. 3 and FIG. 2 will be discussed.

In the lower part 59 of the fractionation column 51 internals are arranged to separate the liquid from the contacting section 58 from the liquid of the two-phase fluid supplied through inlet device 72. The internals include a partition 60 separating a recycle receptacle 61 from a product receptacle 62, a lower guide baffle 63 and an upper guide baffle 64 provided with a chimney 65.

During normal operation, liquid from the contacting section 58 is guided by the upper guide baffle 64 so that it is collected in the recycle receptacle 61. From there the recycle stream is passed through conduit 70 to the cold side 44 of the heat exchanger 41'.

The recycle stream is heated and a heated two-phase fluid is obtained. The heated two-phase fluid is removed from the heat exchanger 41' through conduit 71 and it is introduced into the lower part 59 of the fractionation column 51 through inlet device 72 arranged between the lower and upper guide baffles 63 and 64. The vapour flows upwards through the chimney 65 and through the contacting section 58, and the liquid is collected in product receptacle 62 in the lower part 59 of the fractionation column 51. A product stream of liquefied natural gas having a reduced content of components having low boiling points is withdrawn from the product receptacle 62 through conduit 78. The product stream can be passed to storage or to a further treatment.

There are two advantages associated with separating the liquid from the contacting section 58 from the liquid of the two-phase fluid supplied through inlet device 72. At first the concentration of components having low boiling points in the recycle stream is substantially equal to the concentration of these components in the liquid from the contacting section 58, and this concentration is larger than the concentration of these components in the mixture of liquids collected in the lower part 59 of the method described with reference to FIG. 2. Secondly the temperature of the liquid from the contacting section 58 is lower than the temperature of the liquid from the heated two-phase fluid in the product receptacle 62, and consequently the temperature of the recycle stream is lower than the temperature of the recycle stream if the liquid from the contacting section 58 is mixed with the liquid from the two-phase fluid as is the case in the embodiment of FIG. 2.

Suitably the treating part as described with reference to the FIG. 1–3 is applied in combination with a particular liquefaction process. This embodiment of the present invention will be described in more detail with reference to FIG. 4.

Figure 4:
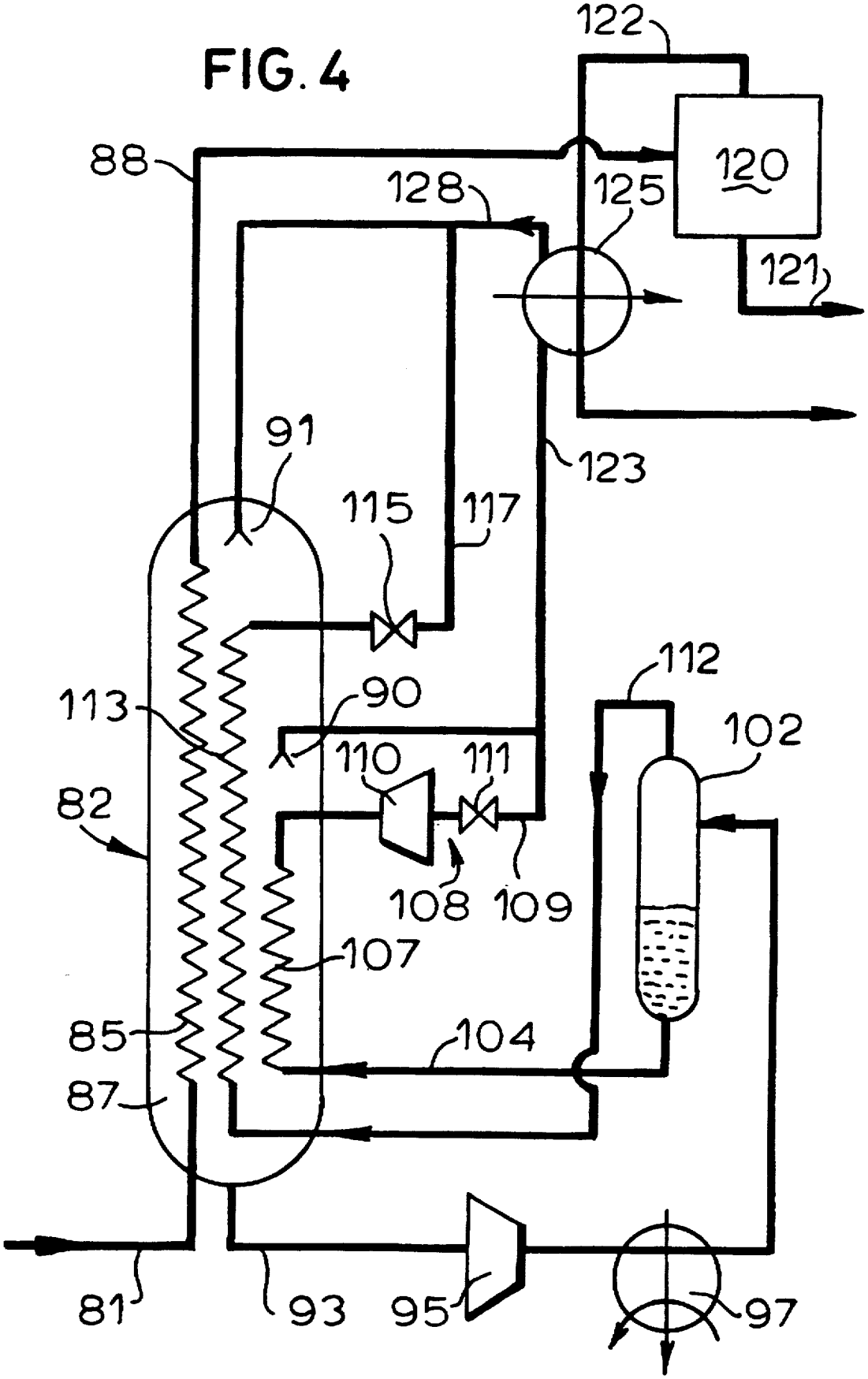
FIG. 4 shows schematically an alternative of the line-up of the process according of FIG. 1.

Reference is now made to FIG. 4, wherein the step of introducing cooled refrigerant at refrigerant pressure in the main heat exchanger differs from the step as described with reference to FIG. 1.

The natural gas containing components having low boiling points is supplied through conduit 81 to a main heat exchanger 82. The natural gas contains about 4 mol % of nitrogen and 200 ppmv (parts per million by volume) of helium. The natural gas is at its liquefaction pressure of 4 MPa.

The main heat exchanger 82 comprises a product side 85 which is in heat exchange relation with a cold side 87.

The natural gas is passed at the liquefaction pressure through the product side 85 of the main heat exchanger 81, and it leaves the product side 85 through conduit 88. The temperature of the natural gas from the main heat exchanger 82 is −150° C.

In order to cool and liquefy the natural gas passing through the product side 85 of the main heat exchanger 82, cooled liquefied refrigerant is introduced in the cold side 87 of the main heat exchanger 82. Cooled liquefied refrigerant is introduced at two levels through inlet devices 90 and 91. The refrigerant is allowed to evaporate at refrigerant pressure in the cold side 87, and vaporous refrigerant is removed from the main heat exchanger 82 through conduit 93. The cooled liquefied refrigerant is obtained in the following way.

Vaporous refrigerant removed from the main heat exchanger 82 is compressed in compressor 95 and cooled in heat exchanger 97 to obtain a partly condensed two-phase refrigerant fluid at elevated pressure. The partly condensed two-phase refrigerant fluid is separated in separator vessel 102 into a first condensed fraction and a first vaporous fraction.

The first condensed fraction is supplied through conduit 104 to a first refrigerant side 107 arranged in the main heat exchanger 82 to obtain a cooled first condensed fraction. The cooled first condensed fraction is allowed to expand in expansion device 108 arranged in conduit 109 to obtain expanded fluid at refrigerant pressure, and the expanded fluid is introduced in the cold side 87 of the main heat exchanger 82 through inlet device 90 arranged at the end of conduit 109 where it is allowed to evaporate.

The expansion device 108 comprises an expansion engine 110 and an expansion valve 111, so that at least part of the expansion being done dynamically.

The first vaporous fraction is supplied through conduit 112 to a second refrigerant side 113 arranged in the main heat exchanger to obtain a cooled second condensed fraction. The cooled second condensed fraction is allowed to expand to the refrigerant pressure in an expansion valve 115 arranged in conduit 117. The cooled second condensed fraction is allowed to evaporate in the cold side 87 of the main heat exchanger 82 at the refrigerant pressure.

Liquefied gas withdrawn from the main heat exchanger 82 through conduit 88 is treated in the treating part which has been discussed with reference to FIGS. 1–3. For the sake of clarity the parts of the treating part have not been shown in FIG. 4, and the treating part is referred to with reference numeral 120.

From the treating part 120 is removed through conduit 121 a product stream of liquefied natural gas having a reduced content of components having low boiling points. The product stream can be passed to storage (not shown) or to a further treatment (not shown). Furthermore from the treating part 120 is removed through conduit 122 a gaseous stream which is enriched in components having low boiling points. This gaseous stream can be used as fuel gas.

Suitably the gaseous stream is used to cool part of the first condensed fraction, and to that end part of the first condensed fraction is supplied through conduit 123 to a heat exchanger 125 where this first condensed fraction is cooled by heat exchange with the gaseous stream. From the heat exchanger the cooled first condensed fraction is supplied through conduit 128 to the conduit 117, and it is introduced in the conduit 117 downstream of the expansion valve 115.

The advantage of the above described method is that in the refrigerant stream only one expansion engine is required. Normally it is expected that to liquefy a natural gas containing nitrogen, the temperature in the top of the cold side of the main heat exchanger 82 should be as low as possible, and therefor the second condensed fraction is expanded over an expansion engine. However, the temperature reduction obtained in the treating part of the present invention is such that the temperature in the top of the cold side need not be so low, and therefore the expansion engine can be omitted and an expansion engine in the cold first condensed fraction suffices.

In the above-described embodiments the contacting section contained sieve trays, however, in place of sieve trays packing or any other suitable gas/liquid contacting means can be used. The pressure in the fractionation column need not be atmospheric, it can be higher provided that the pressure is below the liquefaction pressure.

In the expansion devices 47 and 108, the expansion is done in two stages to prevent evaporation in the expansion engines 48 and 110 and to allow more flexible operation. The expansions can also be done over an expansion engine only, so that all expansion is done dynamically.

The expansion engines used can be any suitable expansion engine, for example a liquid expander or a so-called Pelton-wheel.

The main heat exchangers 2 (in FIG. 1) and 82 (in FIG. 4) are so-called spoolwound heat exchangers, however any other suitable type, such as a plate-fin heat exchanger may be used.

In the line-up as shown in FIG. 1, cooled liquefied refrigerant is introduced in the main heat exchanger 2 at two levels, it may as well be introduced without separation at one level or with a more complex separation at three levels.

The heat exchangers 17 (in FIG. 1) and 97 (in FIG. 4) may consist of several heat exchangers in series, and the same applies to the compressors 15 (in FIG. 1) and 95 (in FIG. 4).

We claim:

1. Method of liquefying and treating natural gas containing components having low boiling points, which method comprises the steps of:

(a) passing the natural gas at liquefaction pressure through the product side of a main heat exchanger;

(b) introducing cooled liquefied refrigerant at refrigerant pressure in the cold side of the main heat exchanger, allowing the cooled refrigerant to evaporate at the refrigerant pressure in the cold side of the main heat exchanger to obtain vaporous refrigerant at refrigerant pressure, and removing vaporous refrigerant from the cold side of the main heat exchanger;

(c) removing the liquefied gas at liquefaction pressure from the product side of the main heat exchanger;

(d) passing the liquefied gas through the hot side of an external heat exchanger to obtain cooled liquefied gas;

(e) allowing the cooled liquefied gas to expand to a low pressure to obtain expanded fluid, at least part of the expansion being done dynamically;

(f) introducing the expanded fluid in the upper part of a fractionation column provided with a contacting section arranged between the upper part and the lower part of the fractionation column;

(g) allowing the liquid of the expanded fluid to flow downwards through the contacting section;

(h) withdrawing from the fractionation column a liquid recycle stream which includes liquid flowing out of the contacting section;

(i) passing the liquid recycle stream through the cold side of the external heat exchanger to obtain a heated two-phase fluid;

(j) introducing at least the vapour of the two-phase fluid in the fractionation column between the lower part and the contacting section, and allowing the vapour to flow upwards through the contacting section;

(k) collecting at least part of the liquid of the two-phase fluid in a product receptacle, and withdrawing from the product receptacle a liquid product stream having a reduced content of components having low boiling points; and (l) withdrawing from the upper part of the fractionation column a gaseous stream which is enriched in components having low boiling points.

2. Method according to claim 1, wherein steps (h) through (k) comprise:

(h') withdrawing from the fractionation column a liquid recycle stream which consists of the liquid flowing out of the contacting section;

(i') passing the liquid recycle stream through the cold side of the external heat exchanger to obtain a heated two-phase fluid;

(j') introducing the vapour of the two-phase fluid in the fractionation column between the lower part and the contacting section, and allowing the vapour to flow upwards through the contacting section; and (k') collecting the liquid of the two-phase fluid in a product receptacle which is in fluid communication with the cold side of the external heat exchanger, and withdrawing from the product receptacle a liquid product stream having a reduced content of components having low boiling points.

3. Method according to claim 1, wherein step (j) comprises introducing the two-phase fluid in fractionation column between the lower part and the contacting section, and allowing the vapour to flow upwards through the contacting section, and wherein step (k) comprises collecting the liquid of the two-phase fluid in the lower part of the fractionation column, and withdrawing from the lower part of the fractionation column a liquid product stream having a reduced content of components having low boiling points.

4. Method according to claim 1, wherein step (h) comprises collecting liquid flowing out of the contacting section in the lower part of the fractionation column, and withdrawing from the lower part of the fractionation column a liquid recycle stream.

5. Method according to claim 1, wherein steps (h) through (k) comprise:

(h") collecting liquid from the contacting section in a recycle receptacle in the lower part of the fractionation column, and withdrawing from the recycle receptacle a liquid recycle stream;

(i") passing the liquid recycle stream through the cold side of the external heat exchanger to obtain a heated two-phase fluid;

(j") introducing the two-phase fluid in the fractionation column between the lower part and the contacting section, allowing the vapour to flow upwards through the contacting section, and collecting at least part of the liquid in a product receptacle arranged in the lower part of the fractionation column; and (k") withdrawing from the product receptacle a liquid product stream having a reduced content of components having low boiling points.

6. Method according to claim 1, wherein the step of introducing cooled refrigerant at refrigerant pressure in the main heat exchanger comprises compressing vaporous refrigerant removed from the main heat exchanger and cooling compressed refrigerant to obtain a partly condensed two-phase refrigerant fluid at elevated pressure; separating the partly condensed two-phase refrigerant fluid into a first condensed fraction and a first vaporous fraction; cooling first condensed fraction in a first refrigerant side of the main heat exchanger to obtain a cooled first condensed fraction; allowing cooled first condensed fraction to expand to obtain expanded fluid at refrigerant pressure, at least part of the expansion being done dynamically; allowing the expanded fluid to evaporate at refrigerant pressure in the cold side of the main heat exchanger; cooling the first vaporous fraction in a second refrigerant side of the main heat exchanger to obtain a cooled second condensed fraction; allowing cooled second condensed fraction to expand to the refrigerant pressure in an expansion valve; and allowing the cooled second condensed fraction to evaporate in the cold side of the main heat exchanger at the refrigerant pressure.

* * * * *